US010485390B2

(12) United States Patent
Murphy et al.

(10) Patent No.: US 10,485,390 B2
(45) Date of Patent: Nov. 26, 2019

(54) BUMPERLESS TOILET LID

(71) Applicant: Kohler Co., Kohler, WI (US)

(72) Inventors: Roger W. Murphy, Kohler, WI (US); Jeffrey T. Laundre, Sheboygan, WI (US); Michael R. Bates, Kohler, WI (US); David P. Ourada, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 581 days.

(21) Appl. No.: 13/791,111

(22) Filed: Mar. 8, 2013

(65) Prior Publication Data

US 2014/0201895 A1 Jul. 24, 2014

Related U.S. Application Data

(60) Provisional application No. 61/754,242, filed on Jan. 18, 2013.

(51) Int. Cl.
*A47K 13/00* (2006.01)

(52) U.S. Cl.
CPC ..... *A47K 13/00* (2013.01)

(58) Field of Classification Search
CPC ..... A47K 13/00
USPC ..... 4/234–240; D23/311
See application file for complete search history.

(56) References Cited

U.S. PATENT DOCUMENTS 1,189,767 A * 7/1916 Wilson ..... A47K 13/00 4/234
2,114,551 A 4/1938 Winding
2,751,604 A 6/1956 Young
3,072,925 A 1/1963 Nyman
3,520,005 A * 7/1970 Downes ..... A47K 13/00 4/234
3,593,349 A 7/1971 Bungo
D262,486 S * 12/1981 Boyter ..... D23/311
4,457,029 A * 7/1984 Matthews ..... 4/237
4,461,046 A 7/1984 Adams
4,747,167 A 5/1988 Adams
4,970,730 A 11/1990 Stain et al.
D338,951 S 8/1993 Witzig
D348,926 S * 7/1994 Rasmussen ..... D23/311
5,361,425 A 11/1994 Armanno, Sr.
(Continued)

FOREIGN PATENT DOCUMENTS

CN 202086410 12/2011
CN 202214798 5/2012
(Continued)

OTHER PUBLICATIONS

Second Chinese Office Action dated Mar. 23, 2013 from related Chinese patent application No. 201410025826.3.

*Primary Examiner* — Tuan N Nguyen
(74) *Attorney, Agent, or Firm* — Foley & Lardner LLP

(57) ABSTRACT

A lid for a toilet including a bottom surface that faces a top surface of a seat for the toilet when the seat is in a lowered position proximate to a bowl of the toilet. The bottom surface of the lid has a sweeping profile that extends along at least a portion of the bottom surface of the lid and is configured to engage the top surface of the seat. A uniform gap between the seat and lid is defined by the sweeping profile of the lid and the material thickness of the lid when both the lid and the seat are in a lowered position.

19 Claims, 9 Drawing Sheets

(56) References Cited

U.S. PATENT DOCUMENTS

| | | | | | |
|---|---|---|---|---|---|
| D465,562 | S | * | 11/2002 | Moore | D23/295 |
| RE38,191 | E | * | 7/2003 | Otte | D23/311 |
| D485,606 | S | * | 1/2004 | Delgado et al. | D23/311 |
| D509,290 | S | * | 9/2005 | Hisey | D23/311 |
| D582,022 | S | * | 12/2008 | Berberet et al. | D23/311 |
| D593,655 | S | | 6/2009 | De Lay | |
| D618,325 | S | | 6/2010 | Deng | |
| 8,091,152 | B1 | | 1/2012 | Rucker et al. | |
| 8,312,571 | B2 | | 11/2012 | Vierkant, III et al. | |
| 2007/0294810 | A1 | | 12/2007 | Vierkant et al. | |

FOREIGN PATENT DOCUMENTS

| | | | |
|---|---|---|---|
| JP | 2010178925 | | 8/2010 |
| KR | 100873282 | | 12/2008 |
| TW | 218106 | A | 6/1982 |
| TW | 218106 | | 12/1993 |

* cited by examiner

BUMPERLESS TOILET LID

CROSS-REFERENCE TO RELATED PATENT APPLICATIONS

This application claims priority to and the benefit of U.S. Provisional Patent Application No. 61/754,242 filed Jan. 18, 2013, the entire disclosure of which is incorporated by reference herein.

BACKGROUND

Modern toilets, such as flush toilets, generally include a bowl which is configured to receive human waste and transport said waste from the bowl to a sewer line. Flush toilets also typically include a tank used to supply fresh water for a flushing and rinsing cycle, a trap used to siphon the contents of the bowl into a sewer line, and various toilet attachments. Typical toilet attachments may include a seat attachment and a lid attachment.

A seat attachment for a toilet is generally mounted to a rear portion of the toilet bowl. Further, a seat attachment (i.e., a seat) is generally configured so that it is pivotable upwards about the rear portion of the toilet bowl. When the seat attachment is in a lowered position, it is configured to allow a person to sit thereon to use the toilet. When the seat attachment is in a raised position, a person may stand to use the toilet. Seat attachments are made from different types of materials, and come in many shapes and sizes to fit the various toilet bowl designs (i.e., round, elongated). Seat attachments also generally include a plurality of bumpers that are configured to interface with the toilet bowl.

A toilet having a seat attachment may also include a lid attachment (i.e., a lid). Lid attachments are configured to rest on top of seat attachments when the seat attachment is in a lowered position on the toilet bowl. Lid and seat attachments are generally mounted in a similar manner to a rear portion of the toilet bowl. Similar to seat attachments, typical lid attachments may pivot upwards about a rear portion of the toilet bowl. In some cases, the lid attachment and seat attachment may use the same mounting points on a rear portion of a toilet bowl. One purpose of a lid attachment is to prevent bathroom odors from escaping the toilet. Another purpose of a lid attachment is to prevent objects from falling into the toilet bowl when the toilet is not in use. Lid attachments may be made from a variety of materials, including a polymeric or composite material made from plastic, wood, metal, or fiberglass.

A lid attachment includes a bottom face that faces the seat attachment when the seat and lid attachments are in lowered positions. The bottom face of a lid attachment may be generally flat. Other lid attachments may have a bottom face that include an outer rim having a uniform height. In either case, lid attachments typically include a plurality of bumpers that interface with the seat attachment.

The bumpers for a lid attachment may be made from the same material as the lid attachment, or from a different material. The bumpers may also be coupled to the lid attachment using a variety of methods. For example, a bumper may be pressed into a recess configured to receive the bumper. Adhesives may be used to couple the bumper to the lid attachment. A bumper may also be integrally formed with the lid.

In the case where the bumper of a lid attachment is not integrally formed with the lid attachment, additional materials or manufacturing processes may contribute to a higher overall manufacturing cost. In the case where the bumper of a lid attachment is integrally formed, additional machining processes may contribute to a higher overall manufacturing cost. Therefore, it may be advantageous to eliminate the traditional bumper for a lid attachment.

SUMMARY

An exemplary embodiment relates to a lid for a toilet including a bottom surface that faces a top surface of a seat for the toilet when the seat and the lid are in a lowered position proximate to a bowl of the toilet. At least a portion of the bottom surface of the lid has a sweeping profile that is configured to engage the top surface of the seat. The sweeping profile of the bottom surface is configured to provide a uniform gap between the lid and the bowl of the toilet when both the lid and the seat are in the lowered position.

Another exemplary embodiment relates to a lid for a toilet including a bottom surface that faces a top surface of a seat for the toilet when the seat and lid are in a lowered position proximate to a bowl of the toilet. The bottom surface of the lid has at least a portion that is convex in the direction of the bowl when the seat and lid are in the lowered position and the portion is configured to engage the top surface of the seat. The convex portion is an integral part of the lid.

Yet another exemplary embodiment relates to a toilet including a bowl, a seat attachment, and a lid attachment. The bowl includes a rim and an upwardly facing opening when the toilet is operably mounted. The seat includes a bottom surface that faces an upper surface of the bowl when the seat is in a lowered position, and a top surface opposite the bottom surface. The lid includes a bottom surface that faces the top surface of the seat when the lid and seat are in a lowered position. The bottom surface includes a convex curvature in the direction of the bowl, and the curvature touches the seat in a plurality of locations when the lid and seat are in the lowered position.

DETAILED DESCRIPTION

Figure 6:
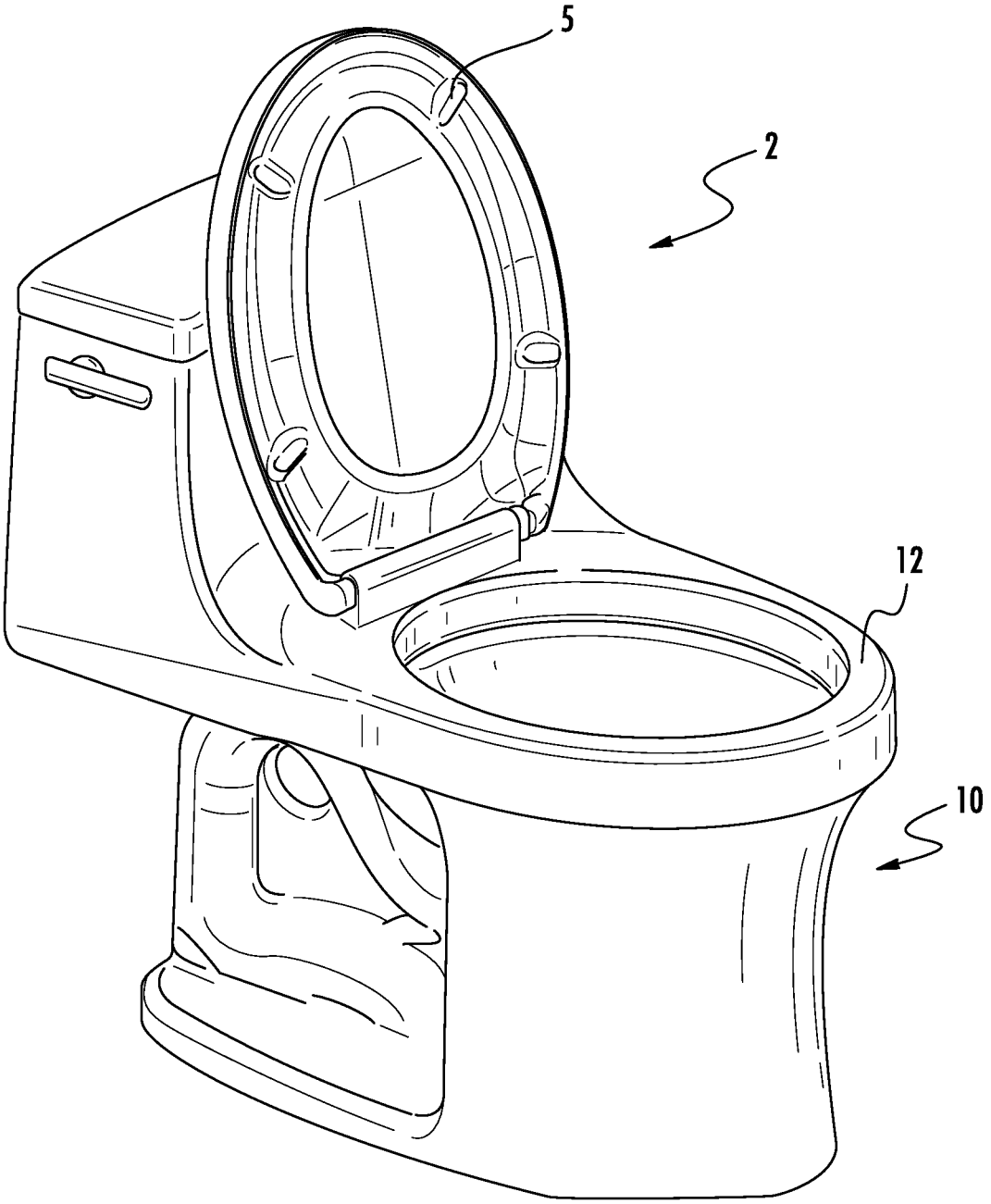
FIG. 6 is a perspective view of a toilet having a lid attachment and a seat attachment, according to the embodiment of FIG. 1, with the lid and seat attachments shown in fully raised positions.

FIGS. 1-7 illustrate an exemplary embodiment of a toilet 10, which includes a bowl, a seat attachment 2, and a lid attachment 1. The bowl of toilet 10 includes an opening which may be generally oval-shaped, as shown in FIG. 6. According to alternative embodiments, a bowl of a toilet may include an opening which may be generally circular, or have another elongated shape.

Figure 1:
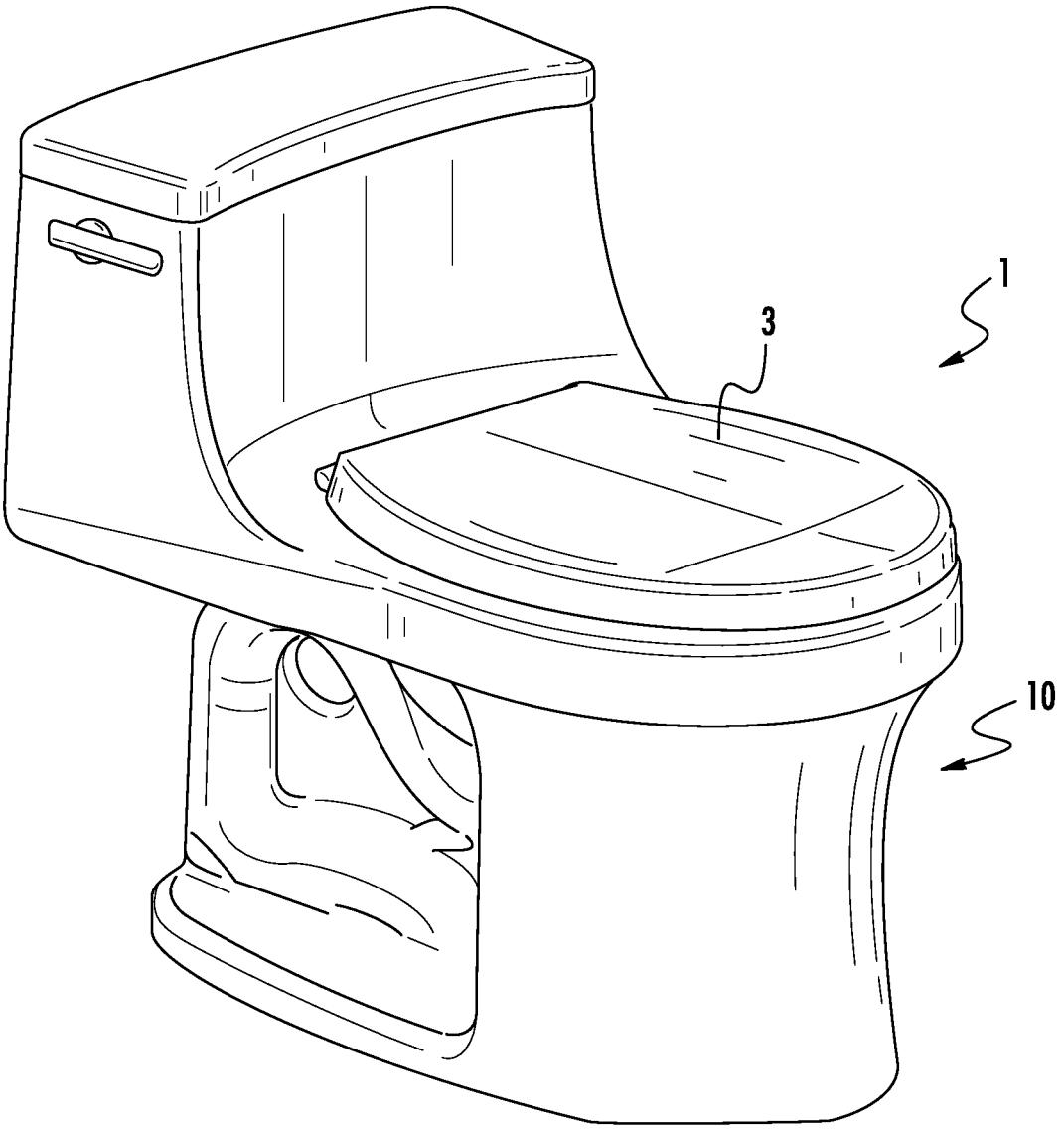
FIG. 1 is a perspective view of an exemplary embodiment of a toilet having a seat attachment and a lid attachment with a sweeping profile.
Figure 2:
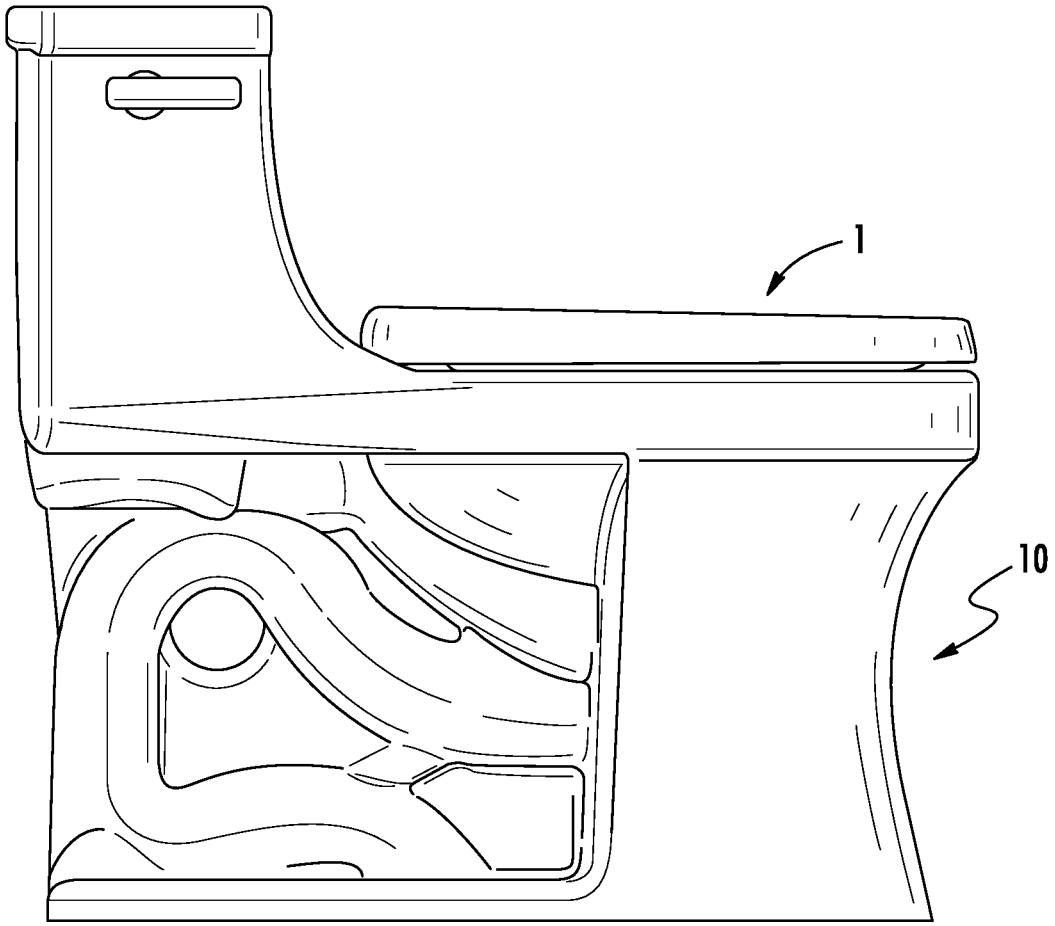
FIG. 2 is a side perspective view of a toilet having a seat attachment and a lid attachment according to the embodiment of FIG. 1.
Figure 7:
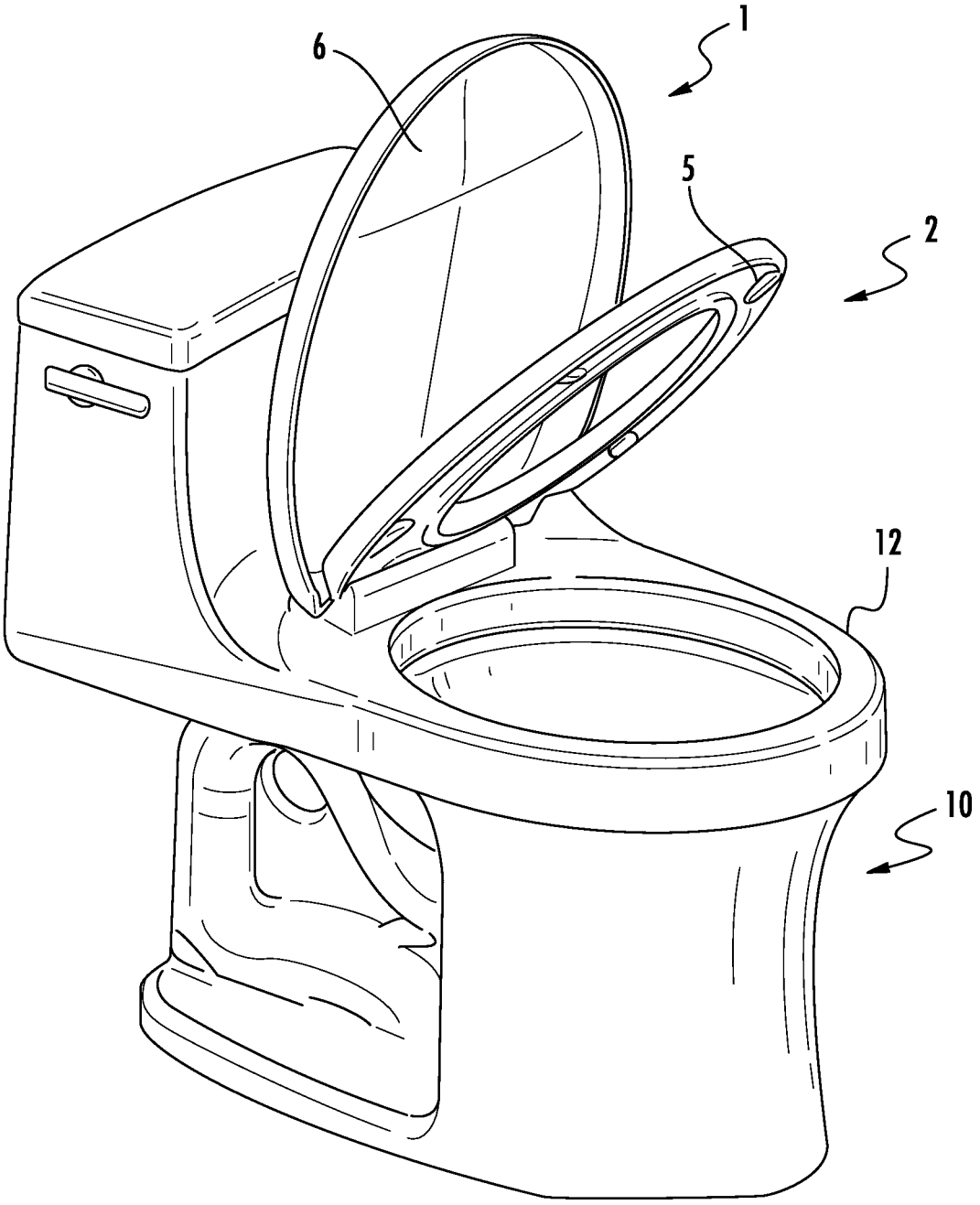
FIG. 7 is a perspective view of a toilet having a lid attachment and a seat attachment, according to the embodiment of FIG. 1, with the lid and seat attachments shown in partially raised positions.
Figure 8:
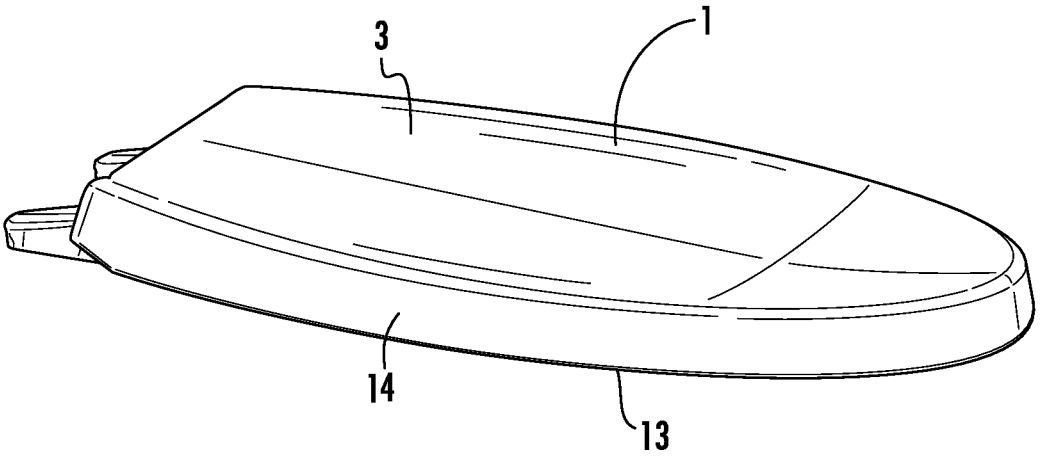
FIG. 8 is a top, front perspective view of a seat and lid attachment, according to the embodiment of FIG. 1.

According to an exemplary embodiment, seat attachment 2 also includes an opening, which is aligned with the opening of the bowl of toilet 10. The seat attachment 2 includes an upper surface 8 that has a curvature that is generally convex in shape. Upper surface 8 of seat attachment 2 is configured for a person to sit thereon. Seat attachment 2 also includes a bottom surface that faces the toilet when the seat attachment is in a lowered position. The outer perimeter of the bottom surface of seat attachment 2, particularly along the front and left/right sides of the seat attachment, may be at a uniform height above toilet 10, when the seat attachment is in a lowered position. The bottom surface of seat attachment 2 includes a plurality of bumpers 5, as shown in FIGS. 6-7. Bumpers 5 are located on either side of seat attachment 2, proximate a front portion of the seat attachment. One purpose for bumpers 5 is to provide stability for the seat attachment when a person is seated thereon. Another purpose for bumpers 5 is to define a uniform gap between seat attachment 2 and toilet 10. Seat attachment 2 is configured to couple to a rear portion of the bowl of toilet 10. Seat attachment 2 is also configured to pivot about a rear portion of the bowl of toilet 10. Seat attachment 2 pivots between a lowered position (as shown in FIG. 1) and a raised position (as shown in FIG. 6).

According to an exemplary embodiment of this disclosure, a lid attachment 1 may be configured to couple to seat attachment 2 or to a rear portion of the bowl of toilet 10. The outer perimeter of lid attachment 1 may be configured to have generally the same shape as the outer perimeter of seat attachment 2. According to various embodiments, lid attachment 1 and seat attachment 2 may share an attachment assembly that couples to a rear portion of toilet 10. According to various embodiments, lid attachment 1 may include an attachment assembly that is separate from an attachment assembly of seat attachment 2. Similar to seat attachment 2, a lid attachment 1 may be configured to pivot about a rear portion of the bowl between a lowered position (as shown in FIG. 1) and a raised position (as shown in FIG. 6). Lid attachment 1 is configured to cover the opening of seat attachment 2 when lid attachment 1 is in a lowered position.

Figure 9:
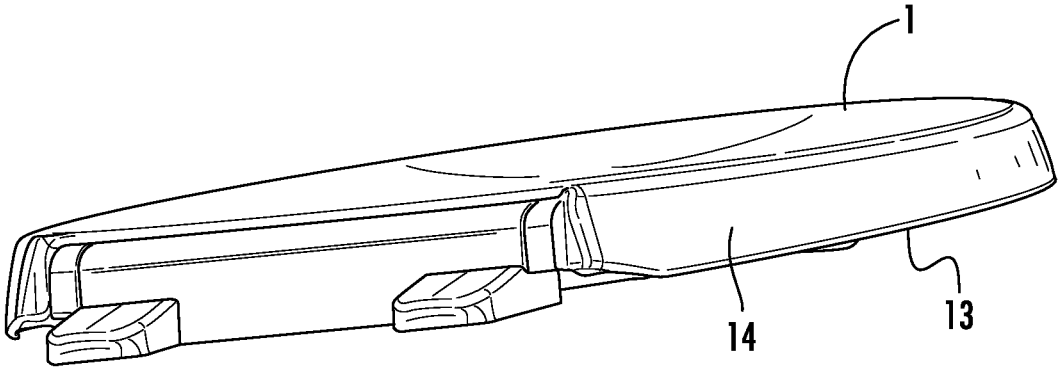
FIG. 9 is a top, rear perspective view of a seat and lid attachment, according to the embodiment of FIG. 1.
Figure 10:
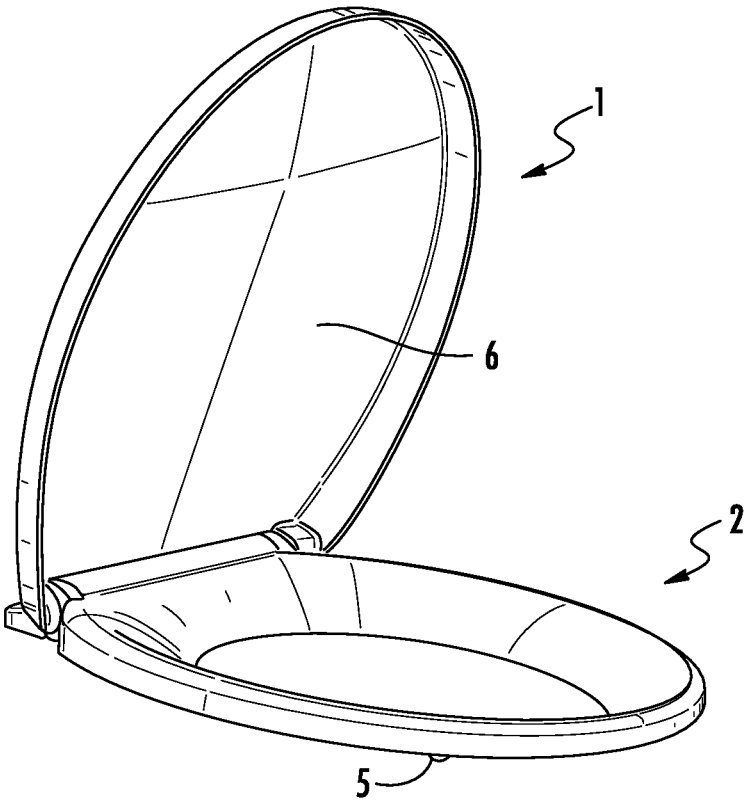
FIG. 10 is a top, front perspective view of a seat and lid attachment, according to the embodiment of FIG. 1, with the lid attachment in a raised position.
Figure 11:
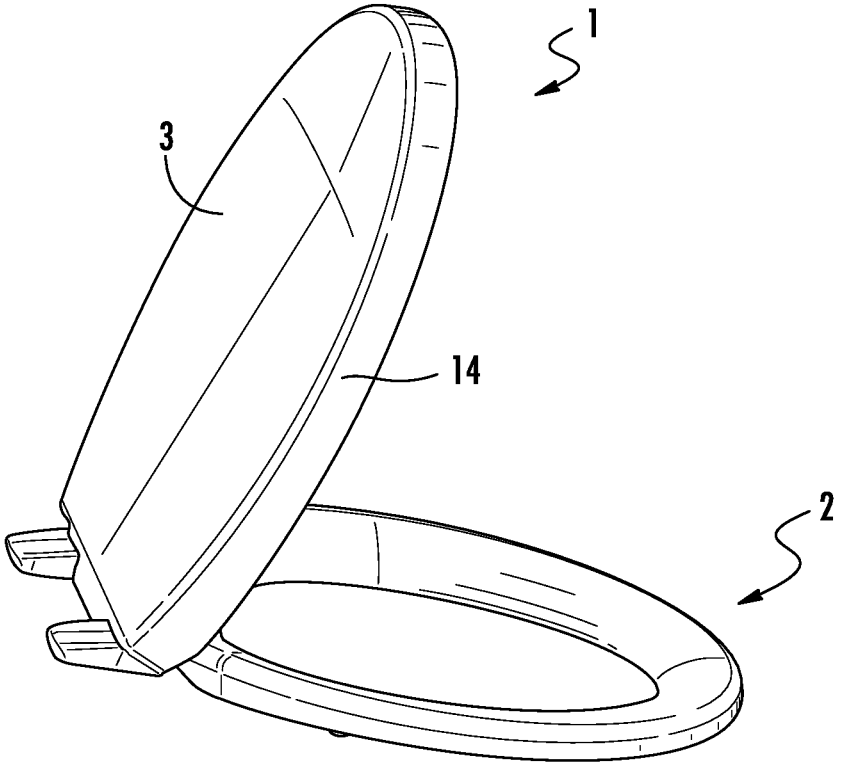
FIG. 11 is a top, rear perspective view of a seat and lid attachment, according to the embodiment of FIG. 1, with the lid attachment in a raised position.
Figure 13:
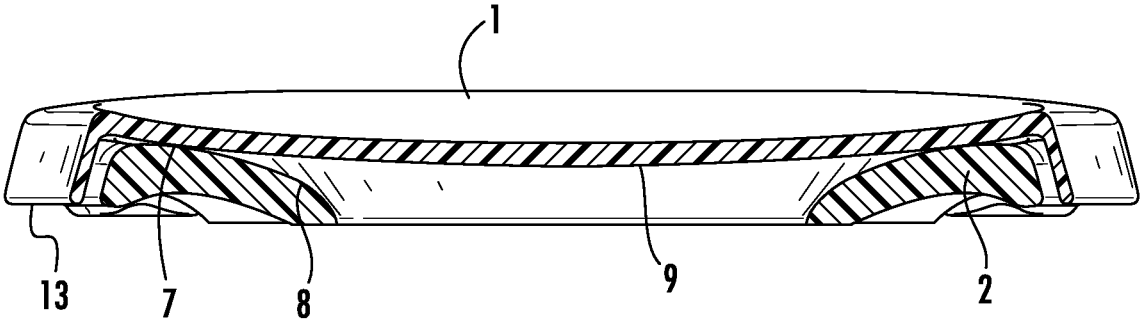
FIG. 13 is a front cross-sectional front view of a lid and seat attachment for a toilet, according to the embodiment of FIG. 1.

As shown in FIGS. 9 and 13, lid attachment 1 may include a lip 14 with a rim 13 that overlaps upper surface 8 of seat attachment 2. When lid attachment 1 is in a lowered position, lip 14 extends downwardly from an upper surface 3 of the lid attachment toward toilet 10. There may also be a generally uniform gap between an inner surface of lip 14 and an outer surface of seat attachment 2, along the front and left/right sides of the lid and seat attachments, when the lid and seat attachments are in a lowered position. The rim 13 may be configured to retain or stabilize lid attachment 1 with seat attachment 2 if a side force is applied to the lid attachment (i.e., in a lateral direction).

Figure 12:
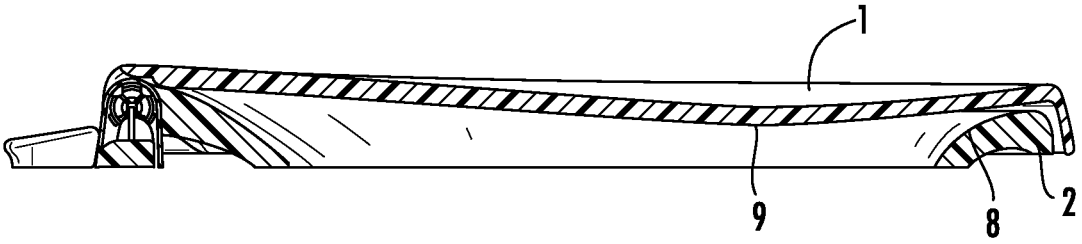
FIG. 12 is a side cross-sectional view of a lid and seat attachment for a toilet, according to the embodiment of FIG. 1.

According to an exemplary embodiment, as illustrated in FIGS. 12-13, the bottom surface 6 of lid attachment 1 may include a sweeping profile 9. One purpose of sweeping profile 9 of lid attachment 1 may be to interact with upper surface 8 of seat attachment 2 when the lid attachment is in a lowered position. Advantageously, sweeping profile 9 may allow for the elimination of a bumper that is typically used on the bottom surface of a lid attachment for a toilet. Therefore, according to an exemplary embodiment, lid attachment 1 may include sweeping profile 9, and may not include a plurality of bumpers.

Referring to FIG. 13, when lid attachment 1 is in a lowered position, sweeping profile 9 interacts with seat attachment 2 at a "touch-off" location 7. According to an exemplary embodiment, touch-off location 7 may be located proximately above bumper 5 of seat attachment 2. One advantage of touch-off location 7 being located proximately above bumper 5 of seat attachment 2 may be to reduce stress on seat attachment 2 and to allow force to be more easily transferred through seat attachment 2, when lid attachment 1 is in a lowered position. Also, touch-off location 7, being located proximately above bumper 5 of seat attachment 2, may provide greater stability of lid attachment 1 when the lid is in a lowered position and a person is seated thereon. A substantial portion of the profile of touch-off location 7 may be located at a particular distance radially from lip 14 of lid attachment 1. Ideally, the width of touch-off location 7 may be approximately ½ inches or less. However, the intent of this disclosure is not to limit the size of a touch-off position of a sweeping profile for a lid attachment, and it may be understood by those skilled in the art that the size of a touch-off position may vary. Further, according to alternative embodiments of this disclosure, the touch-off position of a sweeping profile of a lid attachment may be at some other location which is not proximately above the bumpers of a seat attachment.

Figure 3:
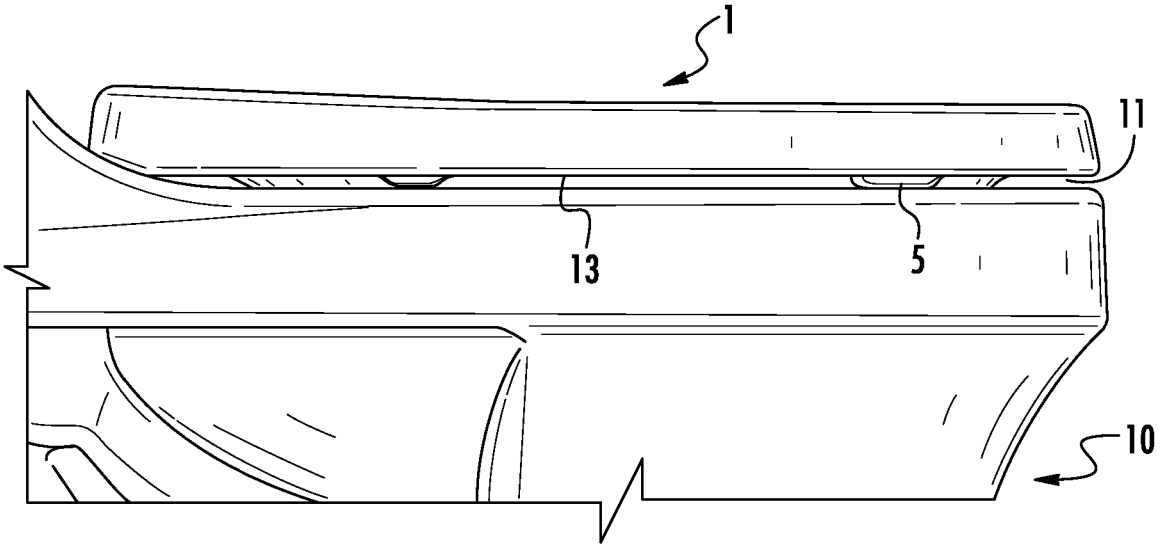
FIG. 3 is a close-up side perspective view of a toilet having a lid attachment and a seat attachment according to the embodiment of FIG. 1.
Figure 4:
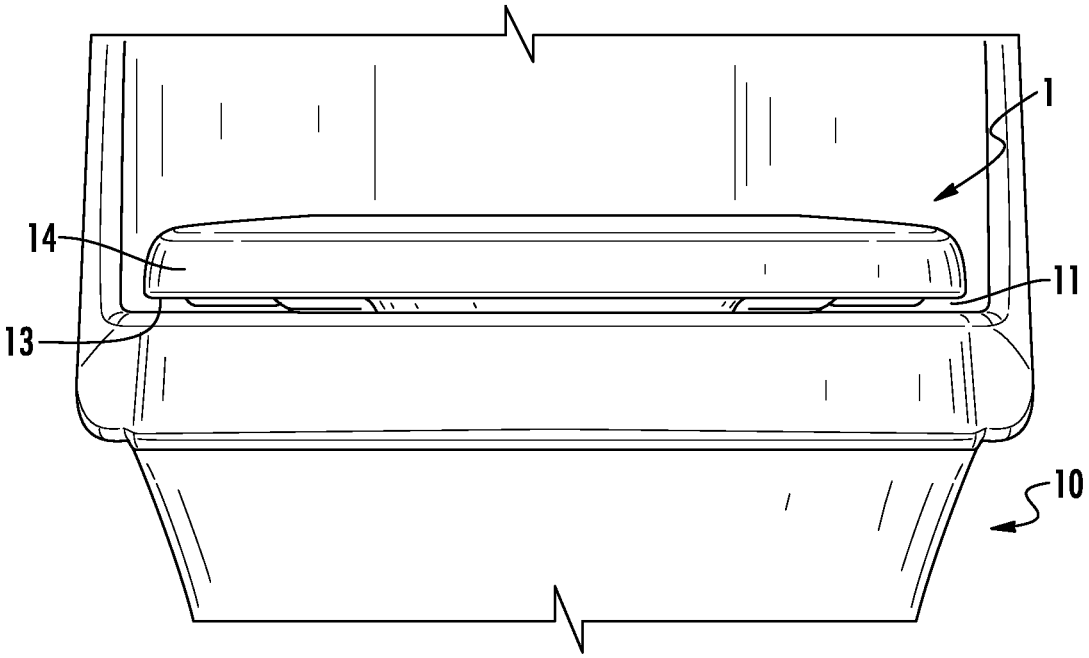
FIG. 4 is a close-up front perspective view of a toilet having a lid attachment and a seat attachment according to the embodiment of FIG. 1.
Figure 5:
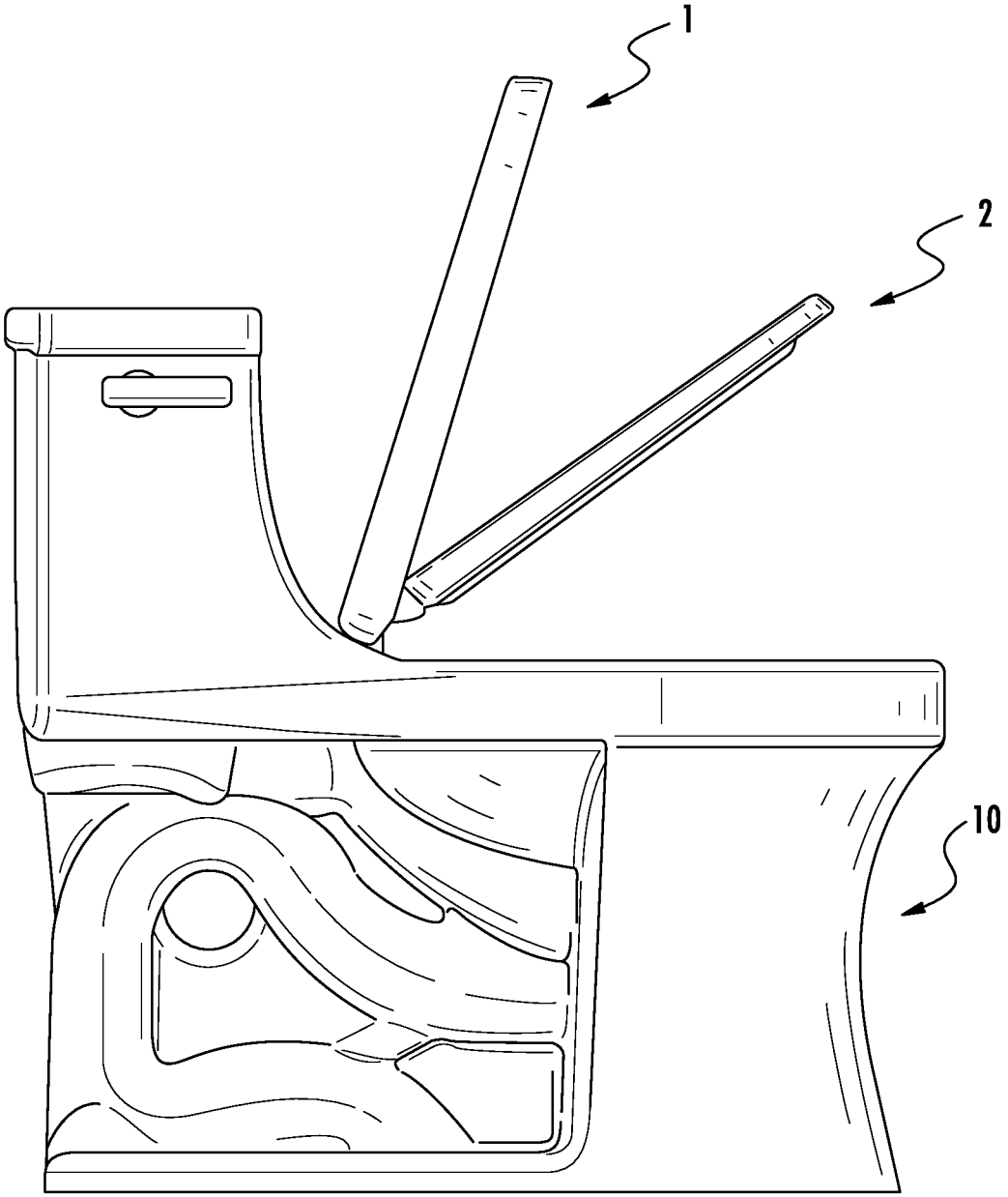
FIG. 5 is a side perspective view of a toilet having a seat attachment and a lid attachment, according to the embodiment of FIG. 1, with the seat and lid attachments shown in partially raised positions.

Referring to FIGS. 3-4, and according to an exemplary embodiment, there may be a substantially uniform gap 11 between rim 13 of lid attachment 1 and an upper surface 12 of the toilet 10, when the lid attachment is in a lowered position. In FIGS. 3-4, uniform gap 11 is shown between the front and left/right sides of the lid attachment and toilet. Uniform gap 11 may be defined by the material thickness of lid attachment 1 and the interaction between sweeping profile 9 and seat attachment 2, when lid attachment 1 is in a lowered position.

As shown in FIG. 12, and according to an exemplary embodiment, the lid attachment 1 includes a bottom surface 6 having a sweeping profile 9 that extends from a rear portion of the lid attachment to a front portion of the lid attachment. The shape of sweeping profile 9 between a rear and front portion of lid attachment 1 may be generally convex in the direction of toilet 10 when lid attachment 1 is in a lowered position. An upper surface of lid attachment 1 may have a contour that generally corresponds to the longitudinal curvature of sweeping profile 9. Therefore, the material thickness between the upper and lower surfaces of lid attachment 1 may be substantially uniform. The convex shape of sweeping profile 9 may center, or align lid attachment 1 on upper surface 8 of seat attachment 2, when the lid is in a lowered position. The alignment of the sweeping profile on upper surface 8 of the seat attachment may provide greater stability of the lid attachment, when a person is seated thereon.

According to this embodiment, sweeping profile 9 also extends between two lateral sides (i.e., a left side and a right side) of lid attachment 1, as shown in FIG. 13. Sweeping profile 9 is generally convex in shape so that the profile rests upon seat attachment 2 in two locations when the lid attachment is in a lowered position. In particular, as FIG. 13 illustrates, sweeping profile 9 is convex between lateral sides of seat attachment 2, so when lid attachment 1 is in a lowered position, sweeping profile 9 rests upon two touch-off locations 7 of upper surface 8 of seat attachment 2. An upper surface of lid attachment 1 may have a contour that generally corresponds to the lateral curvature of sweeping profile 9. Therefore, the material thickness between the upper and lower surfaces of lid attachment 1 may be substantially uniform. As shown in FIG. 13, the convex shape of sweeping profile 9 may center, or align the lid attachment 1 on upper surface 8 of seat attachment 2, when the lid is in a lowered position. The alignment of the sweeping profile on upper surface 8 of seat attachment 2 may provide greater stability of lid attachment 1, when a person is seated thereon.

According to another exemplary embodiment, the bottom surface of a lid attachment may include a sweeping profile that is generally concave in shape between a rear portion and a front portion of the lid attachment. The sweeping profile may be concave in the direction of the toilet, when the lid attachment is in the lowered position. An upper surface of the lid attachment may have a contour that generally corresponds to the longitudinal curvature of the sweeping profile. Therefore, the material thickness between the upper and lower surfaces of the lid attachment may be substantially uniform. According to this embodiment, a uniform gap is defined between the front and left/right sides of the lid attachment and an upper surface of the toilet.

According to another exemplary embodiment, the bottom surface of a lid attachment may include a sweeping profile that is generally concave in shape between two lateral sides (i.e., a left side and a right side) of a lid attachment for a toilet. An upper surface of the lid attachment may have a contour that generally corresponds to the lateral curvature of the sweeping profile. Therefore, the material thickness between the upper and lower surfaces of the lid attachment may be substantially uniform. According to this embodiment, a uniform gap is defined between the front and left/right sides of the lid attachment and an upper surface of the toilet.

According to an alternative embodiment, the bottom surface of a lid attachment may include a sweeping profile that is generally concave in shape between two lateral sides (i.e., a left side and a right side) of a lid attachment for a toilet. An upper surface of the lid attachment may be substantially flat, or planar, when the lid attachment is in a lowered position. According to this embodiment, a uniform gap is defined between the front and left/right sides of the lid attachment and an upper surface of the toilet.

According to an alternative embodiment, a lid attachment for a toilet may include a bottom surface that has a sweeping profile along all or a portion of the bottom surface along one or both of a longitudinal direction and lateral direction of the lid attachment. According to this embodiment, all or a portion of the bottom surface of a lid attachment may be convex, and a portion of the bottom surface of the lid attachment is configured to engage a top surface of a seat attachment. The precise configuration of the curvature of the bottom surface of the lid attachment may vary according to any of a variety of exemplary embodiments, one of which is shown in FIGS. 12-13.

According to various embodiments, a portion of the bottom surface of a lid attachment having a sweeping profile may be generally flat or planar when the lid attachment is in the closed position.

According to various embodiments, the degree of convexity or concavity of a bottom surface of a lid attachment for a toilet can vary. Also, the location at which the bottom surface of a lid attachment touches a top surface of a seat attachment can vary. Further, the slope of the curvature of a bottom surface of a lid attachment for a toilet can vary.

According to various embodiments, sweeping profile 9 may be integrally formed with lid attachment 1. Lid attachment 1 may be made from a variety of materials, including a polymeric material, a composite material, a metal, etc. Sweeping profile 9 may be formed using a variety of manufacturing processes. For example, the lid attachment 1 may be formed using a molding process, an extrusion process, a machining process, or other manufacturing process. According to various embodiments, sweeping profile 9 of lid attachment 1 may not be formed having a uniform thickness across the length and width of the profile.

According to other exemplary embodiments, a lid attachment for a toilet may include a bottom surface having a sweeping profile, and an upper surface that is substantially flat, or planar, when the lid attachment is in a lowered position. The curvature of the sweeping profile may be generally convex or concave in shape.

According to various alternative embodiments, an upper surface of a lid attachment may have the same curvature as a bottom surface of a lid attachment having a sweeping profile. For example, an upper surface may be generally convex in the direction above the lid attachment when the lid attachment is in a lowered position, and a sweeping profile may also be generally convex in the direction of the toilet when the lid attachment is in the lowered position.

In these various embodiments, the sweeping profile of the lid attachment may interface with a seat attachment, and a uniform gap may be defined between the lid attachment and an upper surface of the toilet.

According to various alternative embodiments, the position of a touch-off location between a sweeping profile of a lid attachment and an upper surface of a seat attachment may be in any location along the upper surface of the seat attachment.

One skilled in the art will readily appreciate the benefits of a lid attachment having a sweeping profile which directly interfaces with a seat attachment of a toilet. For example, one benefit of a lid attachment having a sweeping profile is the fact that it may reduce the cost to manufacture a lid attachment, since bumpers may be omitted, which will save both material cost and manufacturing steps/complexity. Additionally, the bottom surface of the seat itself may be engineered in a way so that the sweep of the lid as well as the material thickness are provided in a manner to provide a uniform gap between a portion of the lid (e.g., the rim) and a toilet bowl to which the lid is coupled.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of this disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the lid attachment and seat attachment as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A cover for a toilet, the cover comprising:

a seat;

a lid having a bottom surface configured to face a top surface of the seat when the seat and the lid are in a lowered position proximate to a bowl of a toilet and a rim extending from the bottom surface;

wherein at least a portion of the bottom surface of the lid has a sweeping profile that is convex and is configured to directly engage, without a bumper, only a portion of the top surface of the seat; and wherein the sweeping profile of the bottom surface is configured to provide a uniform gap between the rim of the lid and the bowl of the toilet when both the lid and the seat are in the lowered position.

2. The cover of claim 1, wherein the sweeping profile is an integral part of the lid.

3. The cover of claim 2, wherein the shape of the sweeping profile is convex in the direction of the seat from a rear portion of the lid to a front portion of the lid.

4. The cover of claim 3, wherein the seat includes a plurality of bumpers that are configured to interface with the toilet bowl, and wherein the sweeping profile of the lid is configured to interface with the seat proximate to the bumpers.

5. The cover of claim 4, wherein the sweeping profile of the lid is convex in the direction of the seat across a front portion of the lid, and wherein the sweeping profile interfaces with the seat at a plurality of locations when the seat and lid are in a lowered position.

6. The cover of claim 1, wherein a contour of a top surface of the lid corresponds with at least a portion of the sweeping profile.

7. The cover of claim 1, wherein a top surface of the lid opposite the bottom surface is substantially planar.

8. A cover for a toilet, comprising:

a seat;

a lid having a top surface and an opposing bottom surface configured to face a top surface of the seat when the seat and the lid are in a lowered position proximate to a bowl of a toilet; and a rim extending from the bottom surface;

wherein the bottom surface of the lid has at least a convex portion that is convex laterally across a front portion of the lid in the direction away from the top surface of the lid and the convex portion is configured to directly engage, without a bumper, only a portion of the top surface of the seat; and wherein the portion is an integral part of the lid.

9. The cover of claim 8, wherein the convex portion of the lid and the material thickness of the lid are configured to define a uniform gap between the lid and a top surface of a bowl of a toilet when both the lid and the seat are in the lowered position.

10. The cover of claim 9, wherein said convex portion of the lid interfaces with the seat in a plurality of locations when the seat and lid are in the lowered position.

11. The cover of claim 9, wherein the convex portion of the lid is configured to align the bottom surface of the lid on the top surface of the seat, when both the lid and the seat are in the lowered position.

12. The cover of claim 11, wherein the seat includes a plurality of bumpers that are configured to interface with the toilet bowl; and wherein the convex portion of the lid is configured to interface with the seat at a position proximate to the bumpers.

13. A cover for a toilet, the cover comprising:

a lid, having a lid upper surface and a lid bottom surface, opposing the lid upper surface;

a seat, having a seat upper surface and a seat bottom surface, opposing the seat upper surface; and a lip projecting from the lid, the lip forming a rim having a uniform height;

wherein a portion of the lid bottom surface is convex and is configured to directly engage, without a bumper, only a portion of the seat upper surface when the seat and the lid are in a lowered position proximate to a bowl of a toilet; and wherein the rim is configured to be proximate to the seat bottom surface when the seat and the lid are in the lowered position.

14. The cover of claim 13, wherein the lip is configured to provide a uniform gap between the rim and a bowl of a toilet when the lid is in a lowered position.

15. The cover of claim 13, wherein the portion of the lid bottom surface is convex in the direction away from the lid upper surface.

16. The cover of claim 15, wherein at least a portion of the lid upper surface is convex in the direction away from the lid upper surface.

17. The cover of claim 15, wherein the lid upper surface is substantially planar.

18. The cover of claim 13, wherein the portion of the lid bottom surface has a sweeping profile configured to engage the seat upper surface.

19. The cover of claim 18, wherein the seat includes a plurality of bumpers configured to interface with a bowl of a toilet, and wherein the sweeping profile interface with the seat at a plurality of locations proximate to the bumpers.

* * * * *